US005634589A

United States Patent [19]

Greene

[11] Patent Number: 5,634,589

[45] Date of Patent: Jun. 3, 1997

[54] CLAMP ON MAIL BOX DELIVERY SIGNAL ACCESSORY

[76] Inventor: Don L. Greene, 2825 S. Lafayette St., Shelby, N.C. 28152

[21] Appl. No.: 618,518

[22] Filed: Mar. 19, 1996

[51] Int. Cl.[6] ..... B65D 91/00

[52] U.S. Cl. ..... 232/35

[58] Field of Search ..... 232/17, 35, 30

[56] References Cited

U.S. PATENT DOCUMENTS

| | | | |
|---|---|---|---|
| 2,581,880 | 1/1952 | Price . | |
| 2,808,982 | 10/1957 | Armstrong | 232/35 |
| 3,408,978 | 11/1968 | Duffey . | |
| 3,709,189 | 1/1973 | Widham | 232/35 |
| 4,363,439 | 12/1982 | Manian . | |
| 4,382,542 | 5/1983 | Farris . | |
| 4,492,335 | 1/1985 | Davis . | |
| 4,655,390 | 4/1987 | Martin . | |
| 4,708,286 | 11/1987 | Norris | 232/35 |
| 4,953,783 | 9/1990 | Chambers . | |

*Primary Examiner*—Kenneth J. Dorner
*Assistant Examiner*—Jerry Redman
*Attorney, Agent, or Firm*—Laurence R. Brown

[57] ABSTRACT

A mailbox accessory for indicating mail delivery frictionally grips the entry flap on a mail box of the type having a downwardly tilted entry flap for opening the box to receive mail. The accessory provides bistable positions for a mail delivery flag when the mail box flap is closed, one such position set by the box user when closing the flap after picking up mail cocks the flag into an uppermost position and the other such position pivots the flag into a lowermost position when the entry flap is opened to remove delivered mail.

3 Claims, 1 Drawing Sheet

CLAMP ON MAIL BOX DELIVERY SIGNAL ACCESSORY

TECHNICAL FIELD

This invention relates to mail box delivery signal accessories and more particularly it relates to movable flags attached to mail boxes for indicating that mail has been delivered.

BACKGROUND ART

Various sorts of prior art delivery signal accessories are available. However there are unsolved problems relating to these prior art signalling devices. For example, these devices require installation with brackets, bolts, drilled holes, latches, hinges and other parts that complicate both the installation and the functioning of the devices.

Some devices are oriented so that wind gusts can actuate a flag and give a false alarm. Others require manual operations that are easily overlooked or ignored, particularly if the delivering mail person is required to manipulate some sort of a mechanism. In particular detenting mechanisms are subject to rusting and malfunction when exposed to the all-weather environment in which they operate. Some are tedious to manufacture and thus expensive.

Accordingly it is an objective of this invention to provide an improved mail delivery flag signal for mail boxes simple to operate, substantially automatic, not critical to weather conditions and installable without tools or trouble.

DISCLOSURE OF THE INVENTION:

The improved delivery flag system afforded by this invention is simply two relatively pivoted members such as metal plates, one of which is formed into a frictional clamp for attaching the flag on the mail box flap delivery door. The pivoted members are oriented when installed for maintaining by force of gravity two different stable pivoted positions, one automatically attained bistable position visibly indicating the delivery of mail to the box, and the other manually set bistable position is assumed when the mail taken from the box.

Thus the friction mount installs the pivoted plate members to extend outwardly at an angle to horizontal toward the ground from a position near the bottom of the mail flap door and substantially parallel to each other. Then when the flap door is opened for delivery of mail to the box, the uppermost flap pivots downwardly by force of gravity and remains in a vertical posture until manually reclosed after the mail is removed from the box.

BRIEF DESCRIPTION OF THE DRAWINGS

In the accompanying drawing, wherein similar reference characters are used to identify similar features throughout the several views.

THE PREFERRED EMBODIMENT

The mail box 15 is of the conventional type which has a downwardly pivotable entry flap 16 for opening the box to receive or deliver mail. That flap 16 is frictionally held closed by two latch members 17, 18, and is pivoted at 19 on either side near the bottom of the box.

Figure 1:
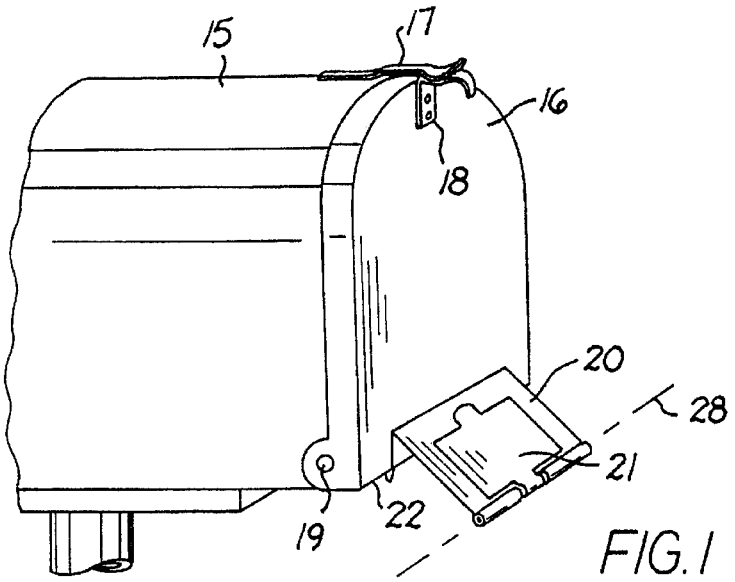
FIG. 1 is a sketch of the signal flag accessory afforded by this invention installed on a mail box and manually positioned for delivery of the mail.
Figure 4:
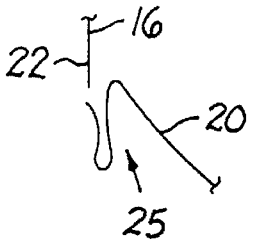
FIG. 4 is a fragmental side view sketch of the frictional clamp for attaching the accessory to the bottom edge of the opening flap.

The accessory attachment is a two piece 20, 21 pivotable assembly where the upper piece 21 as shown in FIG. 1 is the visible flag that indicates mail has been delivered. The remaining piece 20 is the attachment member that has a frictional clamp assembly 25 shown in FIG. 4 for quick attachment of the accessory to the lower edge 22 of the opening flap 16 at the bottom of the box 16. This is formed typically by bending the metal plate 20 into the clamping configuration 25.

Figure 2:
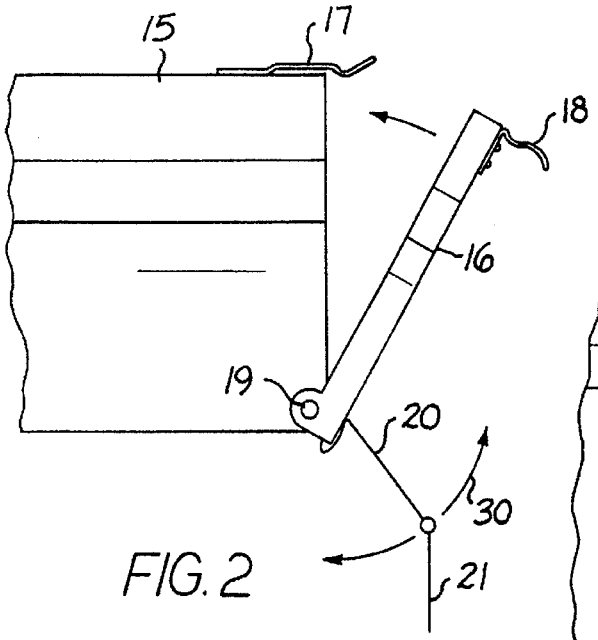
FIG. 2 is a sketch of that mail box after delivery of mail with the opening flap being closed and the signal flag being vertically oriented below the mail box.
Figure 3:
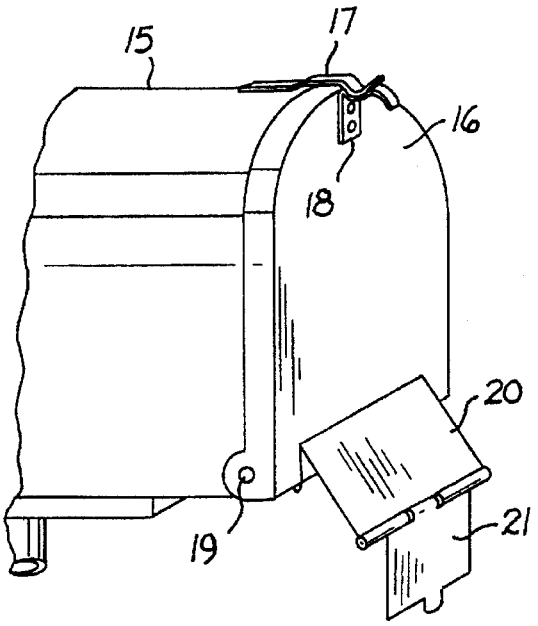
FIG. 3 is a sketch of the mail box with the opening flap closed after delivery of the mail with the flag remaining in the vertical position for viewing from a position remote from the mail box.

The two pieces 20, 21, typically made of galvanized steel sheet, are pivoted about pivot axis 28 by a suitable all weather pivot rod. Thus when the opening flap 16 is opened to deliver the mail, the accessory assembly 20, 21 swings from the off vertical bistable position in FIG. 1 about the arc 30 (FIG. 2) and the flag piece 21 pivots by gravity into its vertically oriented bistable position shown in FIGS. 2 and 3 for visually indicating from a remote position that there has been a mail delivery until it is manually reset when the mail is removed from box 15.

It is therefore seen that this invention has provided a simplified and easily installed mail delivery flag system. Those features of novelty descriptive of the nature and spirit of the invention are thus set forth with particularity in the following claims.

I claim:

1. An accessory having a downwardly pivotable entry flap for attachment to a mail box of the type having the downwardly pivotable entry flap for opening the box to receive delivered mail, the accessory being adapted to provide a visual remote indication when mail is delivered, comprising in combination:

a two piece pivoted assembly comprising a mail box attachment piece and a visual indicator flag piece, a frictional attachment member carried by one of the two pieces for frictionally holding the accessory onto the entry flap with the two pivoted assembly pieces arranged at an off-vertical angle to bistably lie by force of gravity substantially parallel to each other when the entry flap is closed, and to pivot apart by means of gravity when the entry flap is opened to stably reside when the entry flap is reclosed into a second bistable position with the flag piece extending vertically downwardly for visually indicating that mail has been delivered.

2. The accessory of claim 1 wherein the two pivoted assembly pieces comprise flat panels.

3. The accessory of claim 1 for an entry flap comprising a flat metallic panel pivoted on opposite sides to a lowermost position on the mail box, wherein said frictional member comprises a substantially thin metal sheet with a bent over portion of the thin metal sheet that forms the frictional attachment member to frictionally grasp a lowermost edge of the entry flap flat metallic panel.

* * * * *